US007000355B2

(12) United States Patent
Flory et al.

(10) Patent No.: US 7,000,355 B2
(45) Date of Patent: Feb. 21, 2006

(54) ELECTRICAL MULLION

(75) Inventors: Leo Raymond Flory, Decatur, MI (US); Dewain D. Walz, Decatur, MI (US); James T. Clarke, Jr., Richmond, VA (US)

(73) Assignee: Special-Lite, Inc., Decatur, MI (US)

( * ) Notice: Subject to any disclaimer, the term of this patent is extended or adjusted under 35 U.S.C. 154(b) by 0 days.

(21) Appl. No.: 10/390,591

(22) Filed: Mar. 17, 2003

(65) Prior Publication Data

US 2004/0182009 A1 Sep. 23, 2004

(51) Int. Cl.
*E06B 5/00* (2006.01)

(52) U.S. Cl. ..... 49/365

(58) Field of Classification Search ..... 49/365, 49/504; 292/219; 70/58, 65, 57, 101; 160/117, 160/119; 52/204.51
See application file for complete search history.

(56) References Cited

U.S. PATENT DOCUMENTS

| | | | | |
|---|---|---|---|---|
| 5,435,102 | A | 7/1995 | McCarthy | |
| 5,450,697 | A | 9/1995 | Prucinsky et al. | |
| 5,471,792 | A | 12/1995 | Higgins et al. | |
| 5,735,559 | A | 4/1998 | Frolov | |
| 5,765,309 | A | 6/1998 | Mamchych | |
| 5,794,382 | A | 8/1998 | Prucinsky | |
| 5,890,319 | A | 4/1999 | Haeck et al. | |
| 5,941,023 | A | 8/1999 | Mamchych | |
| 6,076,870 | A | 6/2000 | Frolov | |
| 6,082,791 | A | 7/2000 | Frolov et al. | |
| 6,325,429 | B1 | 12/2001 | Oxley | |
| 6,390,520 | B1 | 5/2002 | Holzer | |
| 6,427,387 | B1 | 8/2002 | Hunt | |
| 2001/0003408 | A1 * | 6/2001 | Otto et al. | 312/407 |
| 2001/0048595 | A1 * | 12/2001 | Richardson | 362/92 |
| 2002/0053170 | A1 | 5/2002 | Hunt | |

OTHER PUBLICATIONS

Photographs A-E of prior art mullion discussed in paragraphs [0005], [0006] and [0043] of the instant application, date unknown, 5 pages.

Special-Lite sales literature regarding removable mullion (SL-60) and center post (SL-61) (3 pages), with Photographs F and G illustrating mounting of top fittings for the mullion and center post, 1999 (5 pages).

"Cylinder-Operated Flushbolt 1870 Series", 2 pages from Adams Rite Manufacturing Co. parts order catalog, 2000.

* cited by examiner

*Primary Examiner*—Jerry Redman
(74) *Attorney, Agent, or Firm*—Flynn, Thiel, Boutell & Tanis, P.C.

(57) ABSTRACT

A mullion arrangement for mounting within a door frame including a top fitting secured to an upper frame member or header of the door frame, a bottom fitting secured to the floor beneath the top fitting, and a mullion removably positioned between the top and bottom fittings. The mullion defines therein a cavity which carries cabling therein for supplying power to a component associated with the entryway, such as an electric strike for regulating opening of the door.

30 Claims, 9 Drawing Sheets

ELECTRICAL MULLION

FIELD OF THE INVENTION

This invention relates to a removable mullion arrangement for an entryway or doorway, and particularly pertains to a removable mullion arrangement having the capability of accommodating cabling for a component associated with the doorway.

BACKGROUND OF THE INVENTION

In many buildings, and particularly commercial buildings, double doors supported in metal frames are utilized. A vertically oriented mullion is often utilized in this type of frame so as to divide the double-door opening in half, and single doors are then mounted on opposite sides of the mullion. In many instances the mullion is mounted in a removable manner within the frame, which, after removal of the mullion from the frame, allows the movement of large objects or loads through the doorway.

Due to increasing security and safety measures being taken with respect to various entryways to buildings, it is often desirable to incorporate security devices into doorways or to mount same adjacent doorways. For example, electric strikes for securing hinged or swinging doors are well known in the field of door security systems. The electric strikes are employed with doors having projectable latch bolts that engage the electric strike. The electric strike is typically mounted to the door frame and defines an opening for receiving the latch bolt or dead bolt from the lock set mounted to the door. The strike includes a keeper which is operated so as to selectively open or close the opening in which the door bolt is engaged so as to either allow passage of the bolt through the opening defined in the strike and thus allow opening of the door, or to retain the bolt within this opening so as to prevent opening of the door.

Another type of security device which may be utilized at an entryway is a card reader which allows access only to a person having a coded access card, or an identification device which scans a physical feature of the person such as a thumbprint and allows access only to recognized persons. These types of devices may be utilized in conjunction with an electric strike as discussed above, so as to selectively permit entry of authorized personnel through the doorway through electronic actuation of the keeper of the electric strike. Further, a proximity sensor which is actuated by movement at or adjacent the doorway and which actuates an alarm after sensing such movement may be desirable in some situations. Such devices as described above require electrical power to operate, and thus there is a need for power capability in a removable mullion arrangement. More specifically, electric strike plates are typically mounted on one or both sides of the mullion for controlling opening and closing of one or both doors and thus require connection to a power source. Further, it may be desirable to mount one or more of the other devices discussed above directly to the mullion, for example on the outwardly facing front side thereof for monitoring access to the doorway.

A mullion arrangement having power capability is known. This arrangement includes a mullion which is removably engaged between a top fitting which is secured to the upper horizontal frame member of the door frame, and a bottom fitting which is fixed to the floor. The mullion has a hollow interior in which a power cable is provided for supplying electrical power from a power source to an electrical strike plate mounted on the mullion. The upper end of the mullion mounts thereon a keyed locking mechanism which cooperates with the top fitting to secure the mullion in place between the top and bottom fittings. The top fitting incorporates therein an electrical receptacle which receives a connector provided on a free end of the power cable disposed within the mullion.

However, the top fitting utilized in this known arrangement projects a significant distance downwardly into the doorway when the mullion is removed which creates an obstruction when passing large objects through the doorway. Further, the sleeve-like top fitting which houses the receptacle presents a space problem when connecting the power cable connector to the receptacle, since the installer must reach up into the top fitting to make the connection. Since the space defined within the sleeve-like top fitting is small, manipulation of the cable connector is difficult, particularly since the cable connector must be rotated to align same with the receptacle. A further disadvantage of this mullion arrangement lies in the placement of the locking mechanism at the upper end of the mullion. More specifically, loose wires at the upper end of the power cable can easily become tangled within the components of the locking mechanism.

Accordingly, it is an object of this invention to provide an improved mullion arrangement having power or cable carrying capability which is believed to overcome many of the disadvantages and inconveniences associated with the known arrangement described above. More specifically, the improved mullion arrangement according to the present invention includes a top fitting equipped with a receptacle secured to an upper frame member of a door frame, a bottom fitting secured to the floor beneath the top fitting, and a mullion removably positioned between the top and bottom fittings. The mullion defines a cavity therein in which a cable is disposed, wherein one end of the cable is associated with a component provided on the mullion, and the opposite end of the cable is connected to the receptacle of the top fitting. The top fitting is mounted in substantially flush relation with a lower surface of the upper frame member of the door frame which allows unobstructed access to the receptacle during installation of the mullion, and also avoids obstruction of the doorway when the mullion is removed such as when large items are moved through the doorway.

The mullion arrangement according to the invention additionally includes a locking arrangement located at the bottom of the mullion which cooperates with the bottom fitting so as to securely lock the mullion in position within the doorway, which frees the upper end of the mullion for accommodating cabling.

Other objects and purposes of the invention will be apparent to persons familiar with arrangements of this general type upon reading the following specification and inspecting the accompanying drawings.

Figure 1:
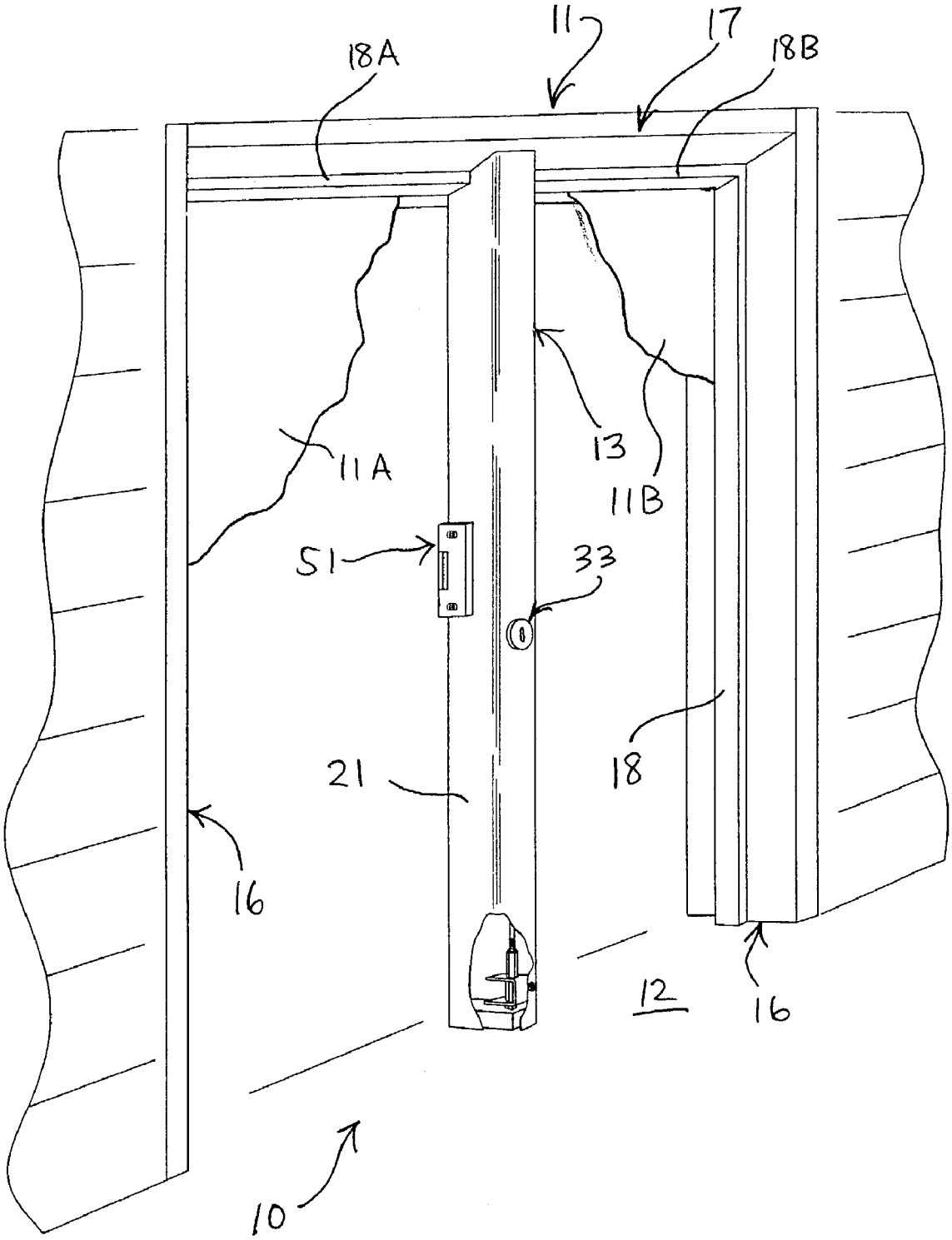
FIG. 1 is a perspective view of a double door frame incorporating a mullion arrangement according to the present invention with the mullion in locked upright position within the door frame.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. The word "front" will refer to the side of the mullion arrangement which faces outwardly towards the doors and away from the interior of the structure in which the doorway is defined, and the word "rear" will refer to the side of the mullion arrangement which faces inwardly and towards the interior of the structure. Said terminology will include the words specifically mentioned, derivatives thereof, and words of similar import.

DETAILED DESCRIPTION

Figure 2:
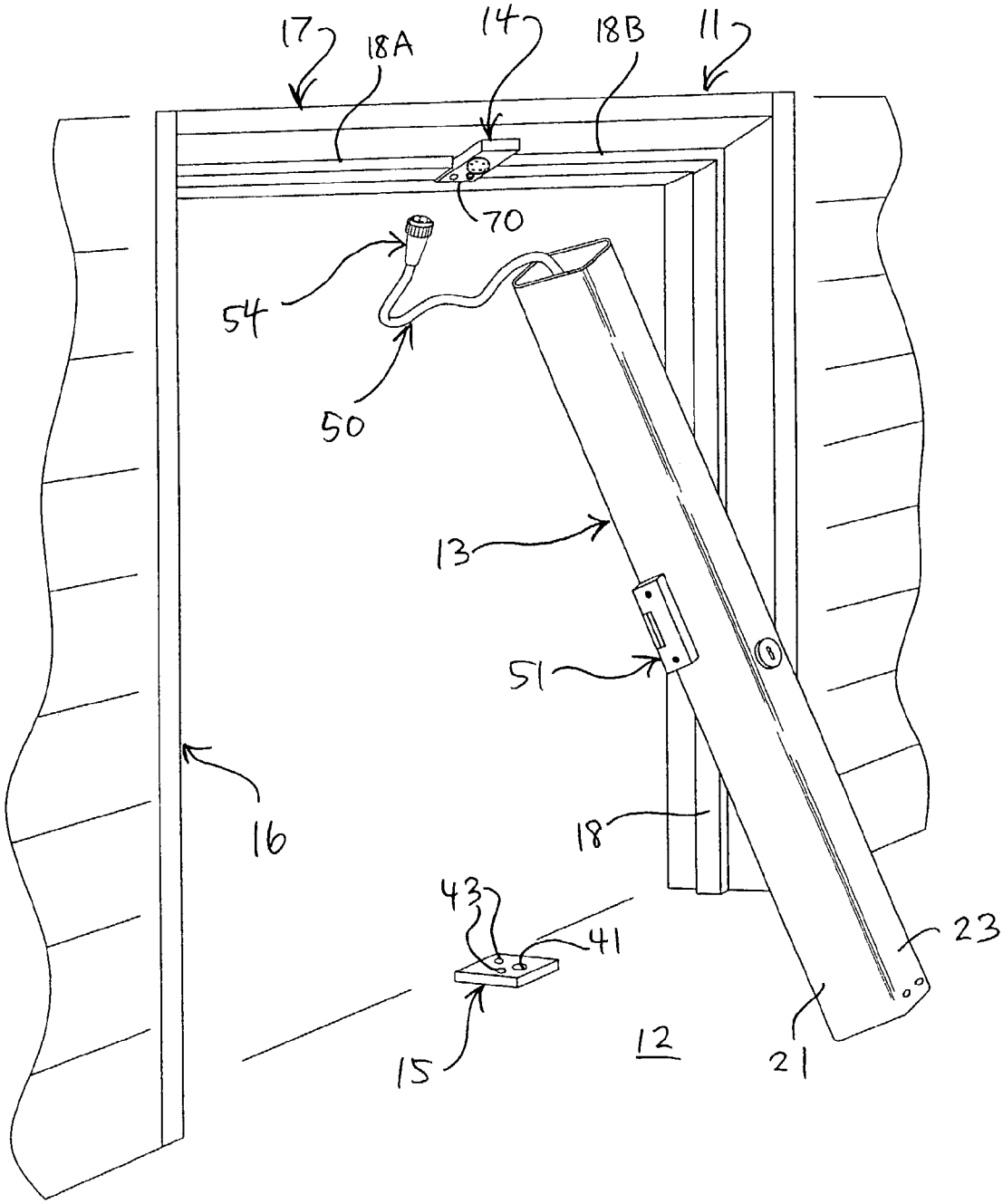
FIG. 2 is a perspective view of the mullion in an inclined assembly position relative to the door frame.
Figure 3:
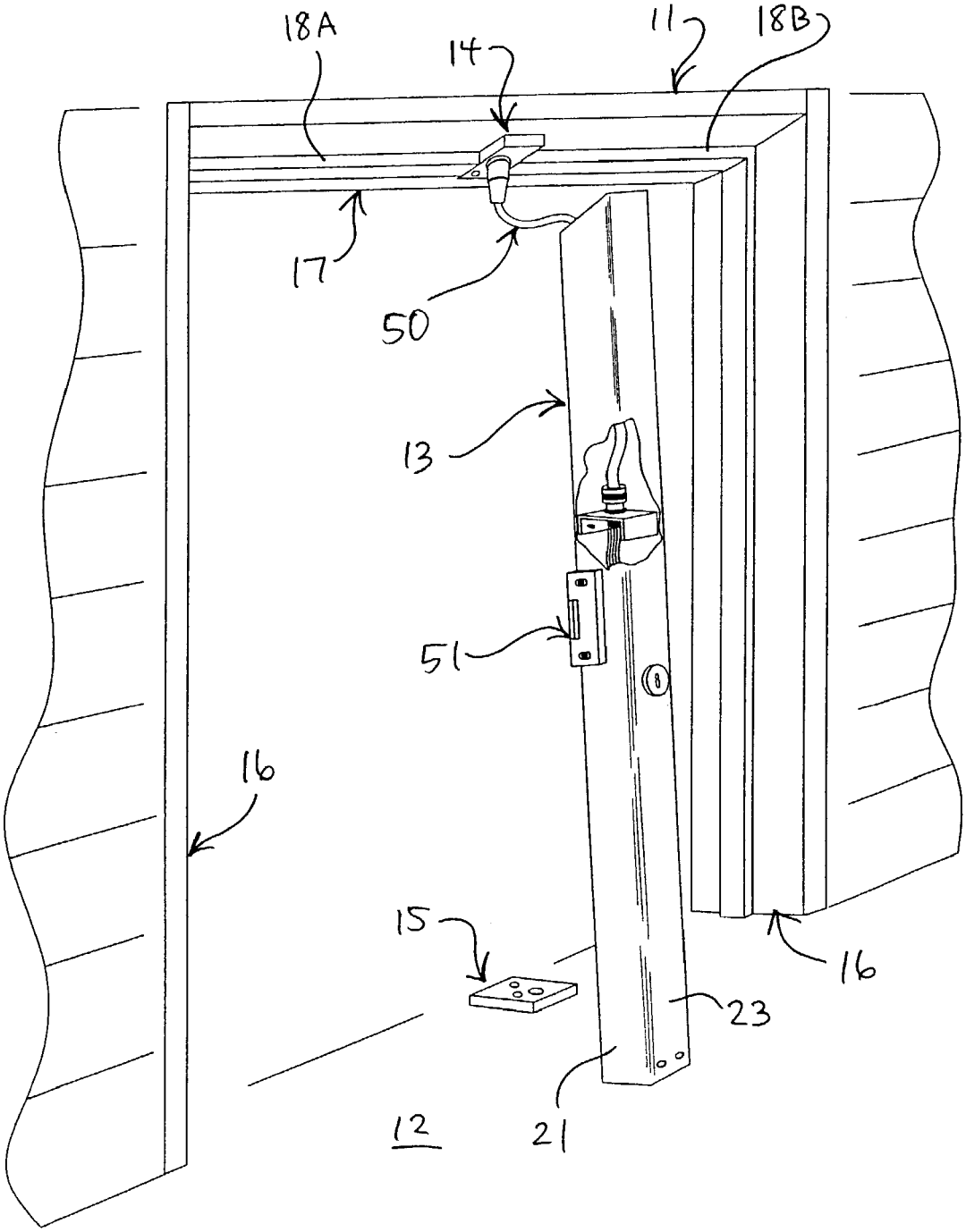
FIG. 3 is a perspective view of the mullion in a downwardly rotated position from that illustrated in FIG. 2 during assembly.

Referring to the drawings, FIG. 1 illustrates a mullion arrangement 10 installed between a double door frame 11 and a support surface such as a floor 12. A pair of doors 11A and 11B are conventionally disposed on opposite sides of the mullion arrangement 10 so as to close off the opening defined within the door frame 11, which are shown only partially in FIG. 1 for purposes of simplicity. Generally, the mullion arrangement 10 includes an elongate mullion 13 which extends between a top fitting 14 fixed to the door frame 11 and a bottom fitting 15 fixed to the floor 12 beneath the top fitting 14, as shown in FIGS. 2 and 3.

The door frame 11 is defined by a pair of generally parallel and upright side frame members 16 which are laterally spaced from one another by a generally horizontally oriented upper frame member or header 17 which extends between upper end portions of the side frame members 16. As is conventional, a door stop 18 extends longitudinally along each of the side frame members 16, and a pair of door stops 18A and 18B are provided along upper frame member 17. As discussed below, the top fitting 14 is disposed between inner termnial ends of door stops 18A and 18B. In the arrangement illustrated herein, the side and upper frame members 16 and 17 are hollow metal extruded components, and the door stops 18, 18A and 18B are separate tubular metal extruded components which are fixed to the respective frame members with fasteners. However, the present invention may be utilized with door frames having side and upper frame members with integral door stops.

Figures 6, 7:
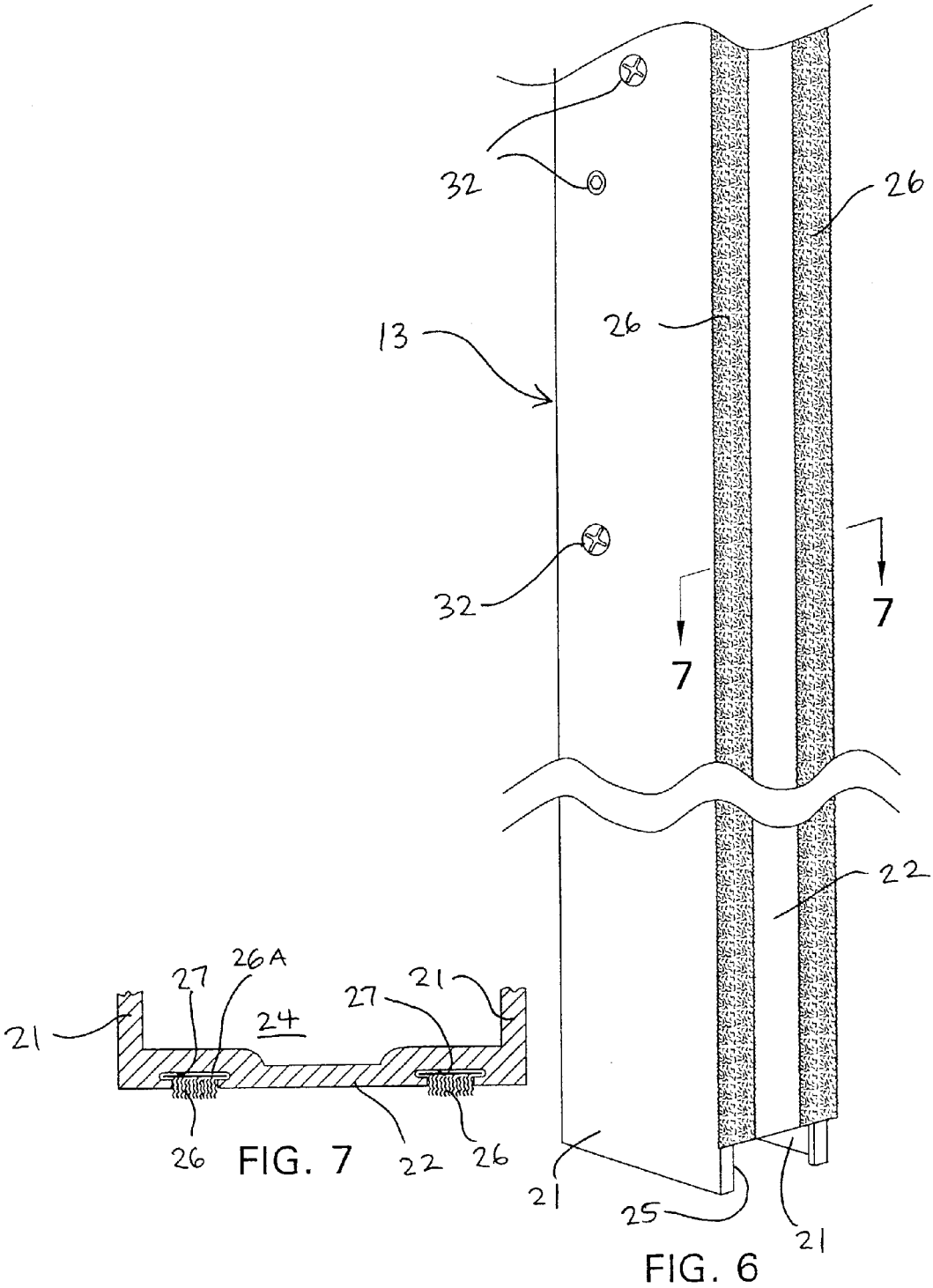
FIG. 6 is an enlarged, fragmentary, perspective view of the lower end of the mullion.
FIG. 7 is an enlarged, fragmentary, cross-sectional view of the front wall of the mullion taken generally along line 7—7 in FIG. 6.
Figure 9:
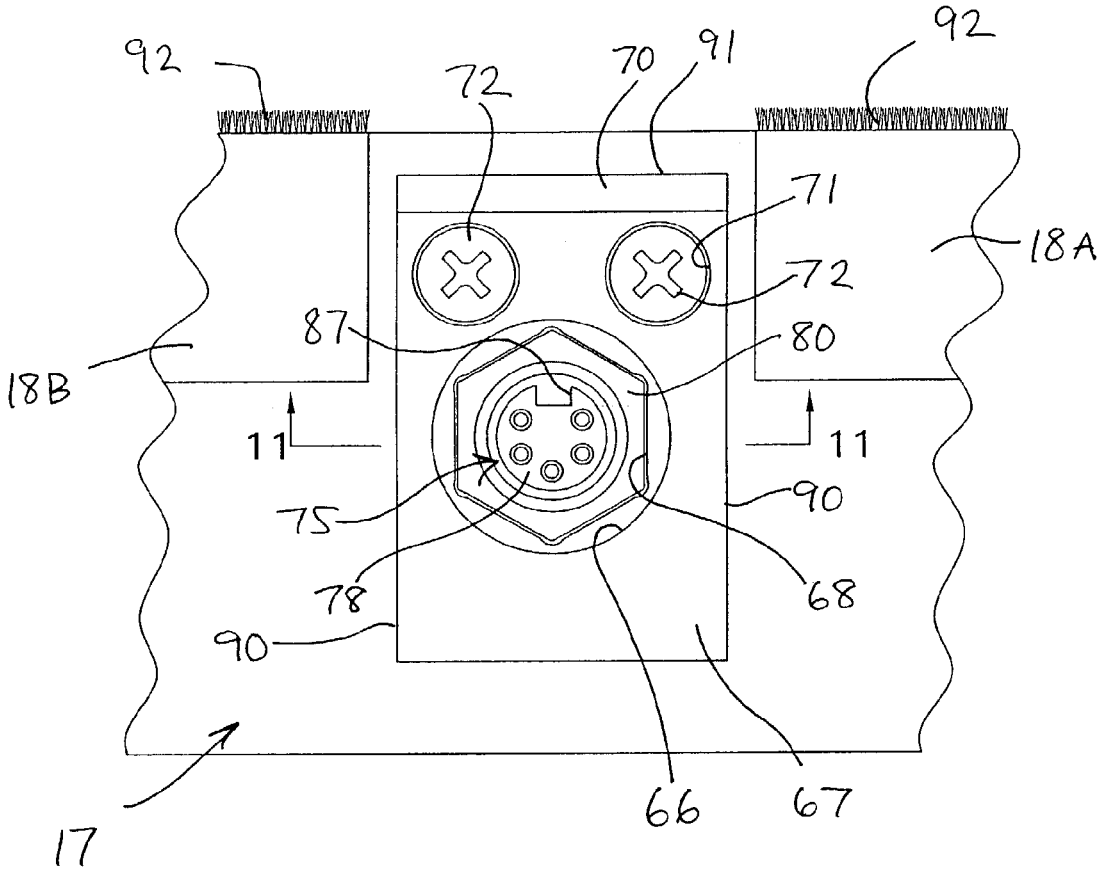
FIG. 9 is a view of the top fitting from below as installed on the underside of the upper frame member of the door frame.

The mullion 13 is an extruded aluminum component having a generally rectangular cross-section defined by a pair of flat and generally parallel side walls 21 and a pair of flat and generally parallel front and rear walls 22 and 23 which extend transversely between and interconnect the respective side walls 21. The side walls 21, 22 and 23 together define an elongate cavity 24 which in the illustrated embodiment extends along the longitudinal length of the mullion 13. As shown in FIG. 6, the front wall 22 of the mullion 13 defines therein a downwardly and frontwardly opening rectangular recess 25. The recess 25 has vertical and horizontal dimensions which are respectively similar to vertical and horizontal dimensions of the bottom fitting 15. Further, the front wall 22 mounts thereon a pair of weather strips 26 which extend along the respective vertical edges of the front wall 22 along the length of the mullion 13. In this regard, the front wall 22 defines therein a pair of elongate and frontwardly opening channels 27. These channels 27 additionally open at the upper and lower horizontal edges of the front wall 22 so that backing strips 26A of the respective weather strips 26 can be inserted into either end of the mullion 13 and then pulled into the respective channels 27. It will be appreciated that the weather strips 26 are disposed at the front wall 22 of the mullion 13 which faces the doors, and serve to seal between the doors and the mullion 13. Weather strip (not shown) is also typically provided along frontwardly facing surfaces of the door stops 18, 18A and 18B so as to engage and seal against the inwardly facing side edges of the respective doors (as shown in FIG. 9).

Figure 4:
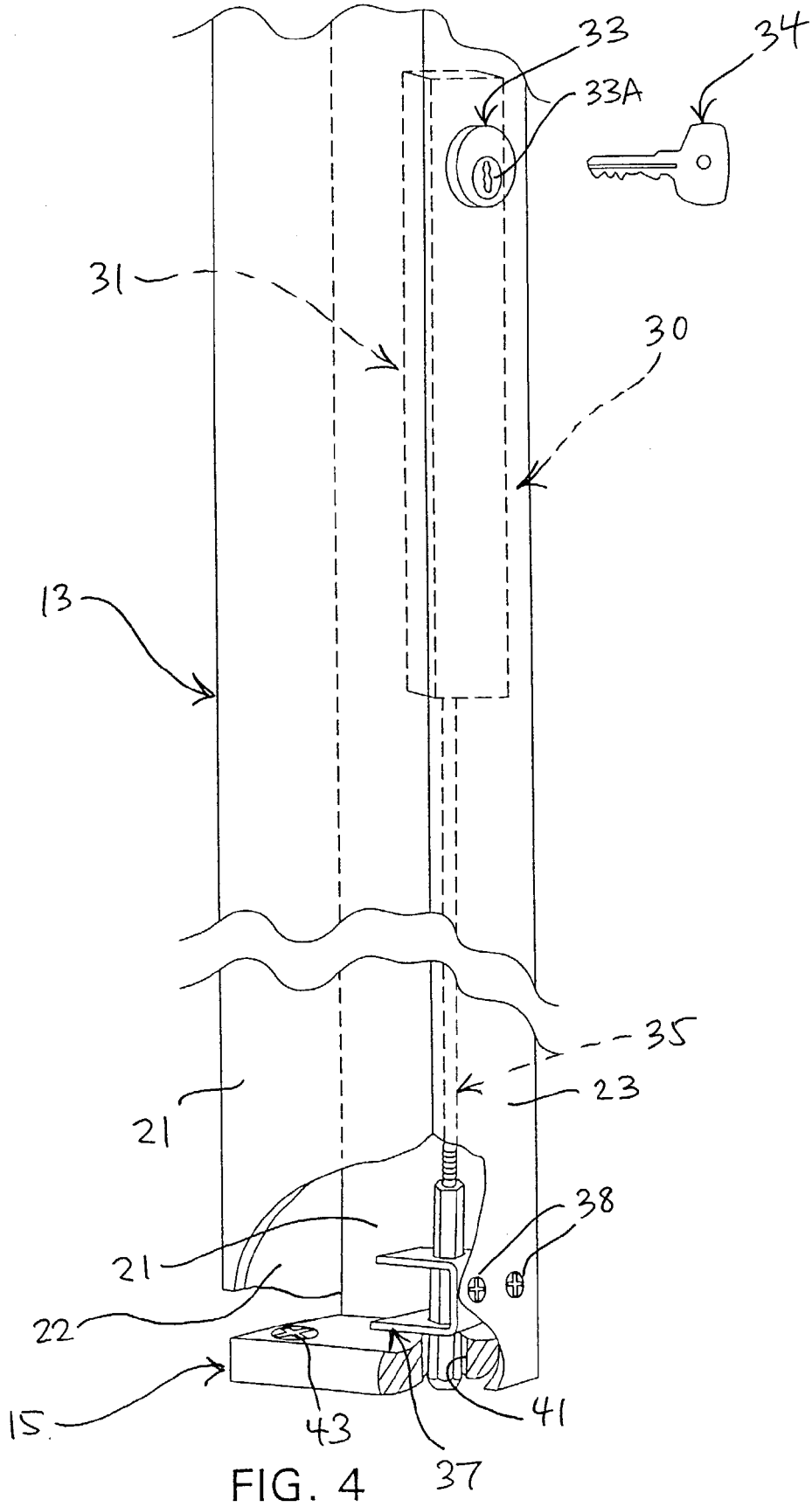
FIG. 4 is an enlarged, fragmentary, perspective view of the lower end of the mullion arrangement, with the side, front and rear walls of the mullion and a portion of the bottom fitting cut-away to show the locking mechanism, and the upper portion of the locking mechanism is shown schematically in broken lines.
Figure 8:
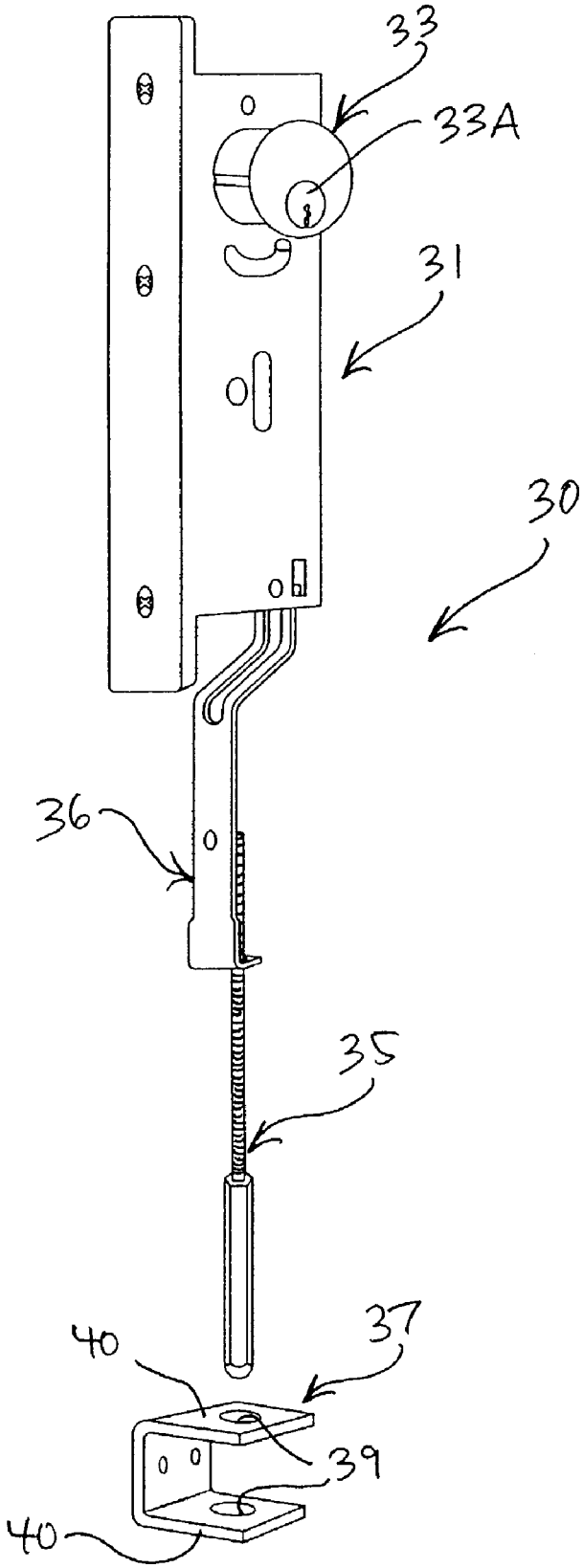
FIG. 8 is an enlarged, exploded perspective view of the locking mechanism shown in FIG. 4.

With reference to FIGS. 1, 4 and 8, a key-actuated locking mechanism 30 is provided within the mullion cavity 24 which cooperates with bottom fitting 15. The locking mechanism 30 is a conventional commercially available cylinder-operated flushbolt arrangement manufactured by Adams Rite Manufacturing Company (1870 Series) and will therefore be only briefly described here. Locking mechanism 30 includes an upper housing part 31 which is secured to side wall 21 of mullion 13 by fasteners 32 (FIG. 6), and includes a lock cylinder 33 mounted so as to project through rear wall 23 and includes a rotating lock barrel 33A configured to accept a key 34. A locking bolt 35 is secured to housing part 31 by an arm 36. The upper end portion of the locking bolt 35 is threaded within a lower end of arm 36 to permit adjustment of the downward extension of the locking bolt 35. The lower end of locking bolt 35 is guided by a C-shaped bracket 37 which is fixed to rear wall 23 by fasteners 38 a short vertical distance above the lower terminal edge of the mullion 13, which distance is similar to the vertical dimension of the bottom fitting 15. Bracket 37 defines therein a pair of openings 39 within respective upper and lower horizontal legs 40 thereof. The respective openings 39 are vertically aligned with one another and sized so as to accept the lower end of locking bolt 35.

Turning now to bottom fitting 15, same is of a block-like metal construction, and is generally rectangular in shape. Bottom fitting 15 defines therein a locking hole 41 adjacent a rear edge thereof, which hole 41 opens upwardly so as to accept locking bolt 35 of locking mechanism 30. Further, a pair of holes are defined within bottom fitting 15 through which fasteners 43 extend so as to secure bottom fitting 15 to the floor 12. The transverse and longitudinal dimensions of bottom fitting 15 are sized so as to allow seating or nesting of the lower end of mullion 13 over and around the bottom fitting 15 as discussed below.

C-shaped bracket 37 is mounted on rear wall 23 so as to be located closely adjacent to the upper surface of bottom fitting 15. Housing part 31 contains therein an overcenter cam mechanism (not shown) which converts rotational movement of lock barrel 33A (when actuated by key 34) into translational movement of locking bolt 35 so as to selectively extend or retract locking bolt 35 into or out of locking hole 41 of bottom fitting 15, respectively.

Figure 5:
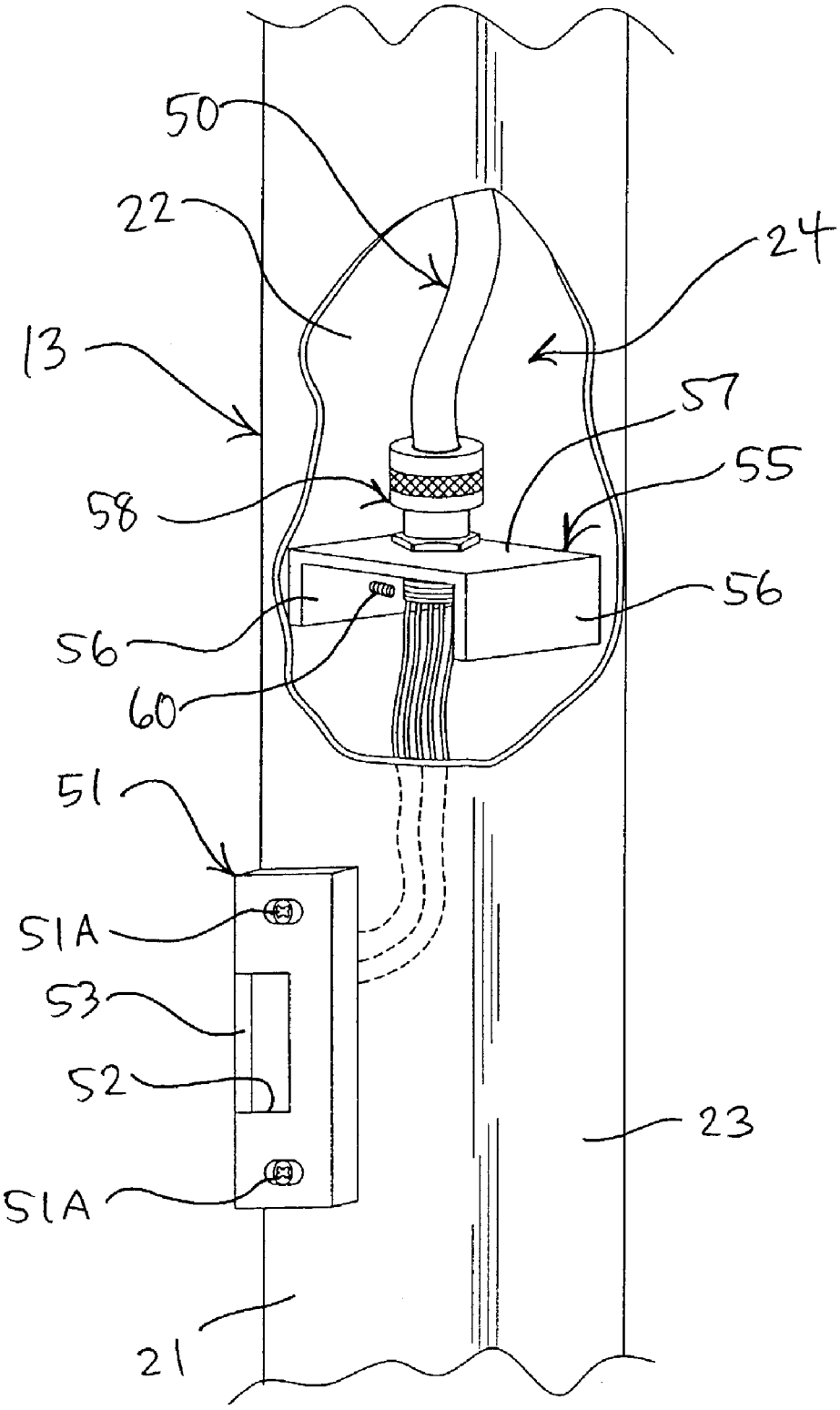
FIG. 5 is an enlarged, fragmentary, perspective view of the mullion with the side and rear walls of the mullion cut-away to show the cable bracket.

As shown in FIG. 5, in the illustrated embodiment the mullion 13 carries a power cable 50 within cavity 24, and an electric strike 51 mounted on side wall 21, and an opening (not shown) is provided in side wall 21 to allow wiring of the strike 51. The strike 51 is mounted on side wall 21 approximately midway along the mullion 13 via fasteners 51A. Electric strikes are well-known conventional components and will therefore be only briefly described here. Strike 51 defines an opening 52 which receives a latch bolt which is part of the lock set mounted to the corresponding door. The strike 51 includes a keeper 53 which is operated so as to selectively open or close the opening 52 to either allow the bolt to pass through the opening so that the door can be opened or to effectively confine the bolt within the opening 52 to prevent opening of the door. In the illustrated embodiment, power cable 50 is an 18 gauge, five conductor, high-flex cord set with a quick change, five-prong male connector 54 at one end which engages with top fitting 14. The opposite end of power cable 50 is suitably connected to electric strike 51. It will be appreciated that any wires of cable 50 which are not needed can be capped and stored within the mullion 13.

With continued reference to FIG. 5, a C-shaped cable bracket 55 is mounted within mullion cavity 24 above electric strike 51 so as to restrain movement of cable 50. More specifically, cable bracket 55 includes a pair of generally upright and parallel legs 56 which are connected to one another by a generally horizontal upper leg 57. Upper leg 57 defines an opening therein which receives a conventional threaded cable restraint 58 through which power cable 50 extends. Cable restraint 58 is fixed to bracket 55 and prevents rotational movement of power cable 50 relative to mullion 13, and restrains movement of the cable 50 within cavity 24 which prevents damage to wire connections at the electric strike 51. One of the upright legs 56 defines therein an opening which receives a fastener 60. The horizontal distance defined between the outer surfaces of the two legs 56 is slightly less than the front-to-back dimension defined between the interior facing surfaces of the front and rear walls 22 and 23 of the mullion 13.

Power cable 50 having cable restraint 58 and cable bracket 55 mounted thereto is secured to mullion 13 by inserting the bracket 55 into the upper open end of the mullion 13 with the leg 56 which receives fastener 60 facing the front wall 22 of the mullion 13 and the opposite leg 56 facing rear wall 23. The bracket 55 is then slid along front wall 22 within cavity 24 until the opening in leg 56 aligns with an opening defined in front wall 22. Once the openings are aligned, the fastener 60 is then threaded through front wall 22 and leg 56 and tightened to secure the bracket 55 within the mullion cavity 24. The opposite end of the cable 50 with connector 54 projects outwardly from the upper end of the mullion 13.

Figure 11:
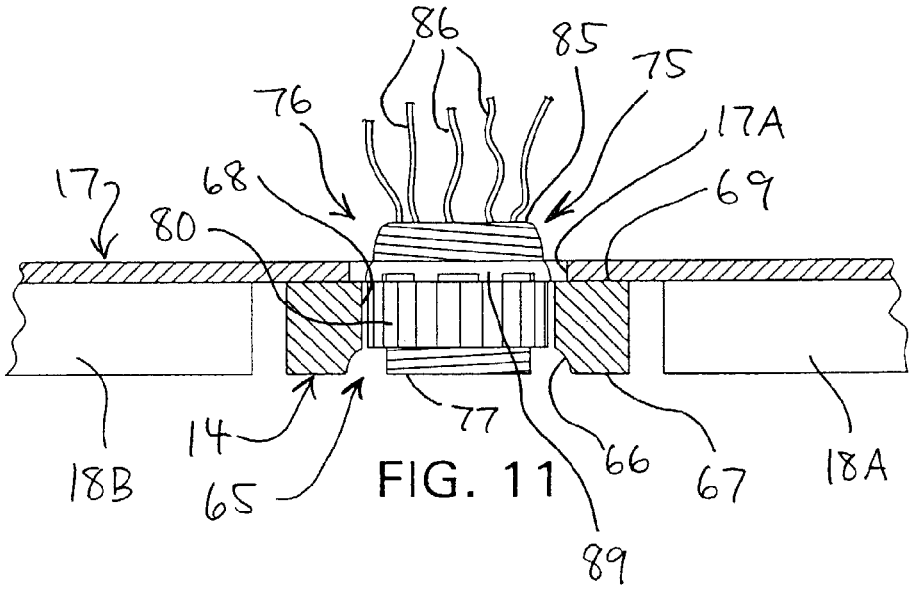
FIG. 11 is an enlarged, fragmentary partial cross-sectional view of the top fitting and upper frame part of the door frame taken generally along line 11—11 in FIG. 9.
Figure 10:
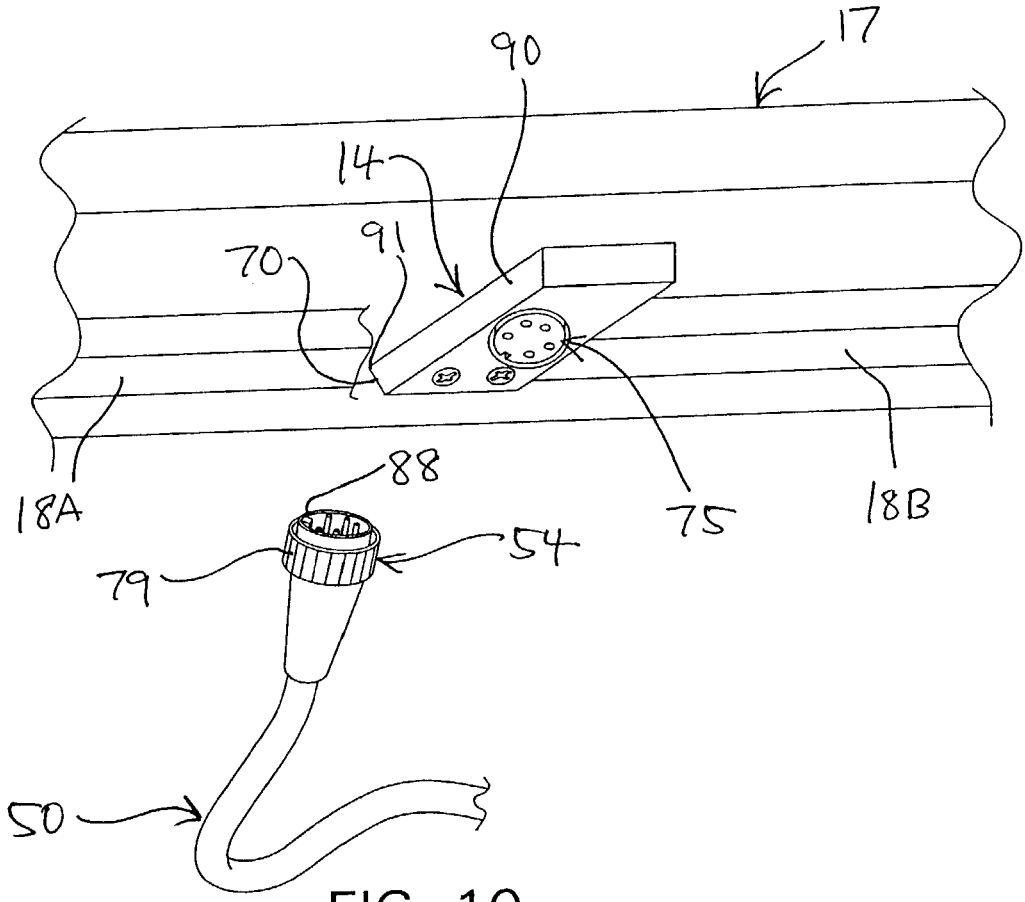
FIG. 10 is an enlarged, fragmentary, exploded view of the top fitting mounted on the upper frame member and the connector of the power cable.

Top fitting 14 is of a block-like aluminum construction and is generally similar in shape to bottom fitting 15. With reference to FIGS. 9–11, top fitting 14 defines a bore 65 therein having a stepped configuration. Bore 65 has a first bore part 66 which opens through a lower surface 67 of top fitting 14. First bore part 66 transitions into a second bore part 68 which has a smaller diameter than first bore part 66, and in the illustrated embodiment is machined so as to have a hexagonal shape. Second bore part 68 opens through an upper surface 69 of top fitting 14. With reference to FIGS. 9 and 10, top fitting 14 has a beveled front edge 70, and defines therein a pair of fastener holes 71 disposed on opposite sides of the bore 65 for fasteners 72 which are utilized to secure top fitting 14 to upper frame member 17 of door frame 11.

Top fitting 14 mounts therein a female connector 75 configured to accept male connector 54 of cable 50. In the illustrated embodiment, female connector 75 is a conventional 18 gauge, five conductor, quick-change receptacle. Connector 75 includes a housing 76 defined by an externally threaded lower sleeve 77 which surrounds a connector face 78 and engages with an internally threaded rotatable sleeve 79 provided on male connector 54 of power cord 50, a hexagonally-shaped central part 80, and an externally threaded upper end 85 which receives therein five conductor wires 86. Connector face 78 defines therein a polarization groove 87 which mates with a corresponding polarization rib 88 defined on male connector 54. The central part 80 is non-rotatably engaged within the hexagonally-shaped second bore part 68 of top fitting 14 so that the lower sleeve 77 is disposed within first bore part 66. A lock nut 89 is then threaded onto upper end 85 of housing 76 to lock the connector 75 to top fitting 14.

With reference to FIGS. 9 and 10, the top fitting 14 is mounted to the upper frame member 17 between door stops 18A and 18B via fasteners 72 which extend into corresponding openings formed in upper frame member 17. The upper end 85 and lock nut 89 of connector 75 extend upwardly through an opening 17A defined in upper frame member 17, and the upper surface 69 of top fitting 14 is superimposed upon and clamped to the lower surface of upper frame member 17. Wires 86 of connector 75 are appropriately connected to the electrical wiring of the building or structure in which the doorway is provided.

The inner terminal ends of the door stops 18A and 18B are horizontally spaced from one another by a distance which is slightly larger than the distance defined between outer surfaces of the respective parallel side walls 21 of the mullion 13. The top fitting 14 is mounted to upper frame member 17 between inner terminal ends of door stops 18A and 18B so that the longitudinal edges 90 of top fitting 14 are spaced equal distances from the respective terminal edges of the respective door stops 18A and 18B, and so that the upper edge 91 of the beveled rear edge 70 of top fitting 14 is spaced rearwardly from frontwardly facing upright edge portions 92 of the respective door stops 18A and 18B by a distance which is similar to the thickness of front wall 22 of mullion 13. The space defined between each longitudinal edge 90 and the opposed terminal edge of the adjacent door stop 18A or 18B is similar to the thickness of the respective side walls 21 of the mullion 13.

To install the mullion 13 within the door frame 11, the mullion 13 is positioned so that the upper end is near the top fitting 14 and the lower end is disposed rearwardly of bottom fitting 15 as shown in FIG. 2, the polarization rib 88 of male connector 54 of power cord 50 is then aligned with the polarization groove 87 of female connector 75, the connector 54 is inserted into the connector 75, and the sleeve 79 is rotated so as to threadingly engage sleeve 77. With the power cable 50 connected to top fitting 14 (FIG. 3), the upper end of the mullion 13 is moved upwardly and slid over the top fitting 14, and the lower end of the mullion 13 is pivoted forwardly so that bottom fitting 15 slides through recess 25 in front wall 22 of mullion 13. The lower end of mullion 13 is pivoted forwardly until the rear wall 23 abuts the rear terminal edge of bottom fitting 15. The locking bolt 35 of locking mechanism 30 is then extended downwardly into locking hole 41 of bottom fitting 15 by turning the key 34 in the appropriate direction, which effectively locks the mullion 13 within the door frame 11 between the top and bottom fittings 14 and 15.

When it is desirable or necessary to remove the mullion 13 from the door frame 11, the key 34 is turned in the appropriate direction to retract the locking bolt 35 from the bottom fitting 15, the lower end of the mullion 13 is pivoted rearwardly relative to the bottom fitting 15 to disengage the mullion from fitting 15, and the mullion 13 is then lowered downwardly so as to disengage the upper end of the mullion 13 from the top fitting 14, and the connector 54 disengaged from connector 75.

With the mullion arrangement 10 according to the invention, electrical power can be provided to various components associated with the entryway defined by door frame 11, such as the electric strike 51 discussed above. It will be appreciated that only one electric strike 51 may be utilized with mullion 13, or a pair of electric strikes 51 can be mounted on the respective side walls 21 of mullion for cooperation with the doors. A single electric strike 51 is often utilized in situations where one of the doors mounted in door frame 11 is inactive or kept in a locked condition, and the opening of the opposite active door is regulated by the electric strike 51. A pair of electric strikes 51 may be utilized so as to regulate the opening of both of the doors, and in this situation the power cable 50 can be suitably wired to the strikes 51 as appropriate.

The power cable 50 can also be utilized to power additional devices associated with the entryway which may or may not be utilized in conjunction with an electric strike or strikes, such as proximity sensors, proximity card readers, card readers, identification devices, cameras, alarms, etc. It will also be appreciated that power and/or communication cabling may be provided interiorly of the mullion 13 according to the present invention, depending upon the type of device utilized in association with the entryway.

The mullion arrangement 10 according to the invention may be utilized in new structures or buildings, or may be retrofitted into existing buildings. In the situation wherein the mullion arrangement 10 is to be incorporated into a new building, the assignee hereof typically supplies the door frame, and thus the top fitting 14 is installed on the upper frame member 17 at the factory. Further, the mullion 13 is typically manufactured so as to have a predetermined excess length so that the mullion 13 can be cut to the desired length in the field during installation. In this situation, prior to cutting the mullion 13, the cable bracket 55 and cable 50 are removed from the mullion 13 by removing fastener 60 and pulling the cable 50 and bracket 55 from the cavity 24 and out of the upper end of the mullion 13. The distance between the lower surface of the upper frame member 17 and the floor 12 is measured to determine the length of the mullion 13, and the top of the mullion 13 is then trimmed to the desired length. The cable 50 and bracket 55 are then reinstalled into the mullion cavity 24 as discussed above, the power cord connector 54 is connected to the connector 75 of the top fitting 14, and the top end of the mullion 13 is slid over the top fitting 75. One door is then closed and the mullion 13 aligned with one of the doors. All four sides of the lower end of the mullion 13 are marked on the floor 12, and the mullion 13 removed from the door frame 11. The bottom fitting 15 is aligned with the front (door side) mark of the mullion 13, centered side-to-side between the longitudinal markings of the mullion 13, and then fastened to the floor 12 with fasteners 43. The mullion 13 is then reinstalled within the door frame 11 as discussed above, and the electrical hardware, such as strike 51, is installed and connected to cable 50.

When retrofitting the mullion arrangement 10 into an existing door frame, the exact center of the doors is marked on the upper frame member 17 and on the corresponding door stop, and the front edge of the door stop is marked on the upper frame member 17. The door stop is then removed from the upper frame member 17. The top fitting 14 (without the female connector 75 installed therein) is then placed along the upper frame member 17 so that the front beveled edge 70 is approximately 9/32 inch behind the line marking the front edge of the door stop, and so that the center of the front edge 70 is aligned with the marking on the frame member 17 corresponding to the center of the doors. The fastener hole locations and hole location for connector 75 are then marked on the upper frame member 17 and holes are drilled, the connector 75 is fastened to the top fitting 14, and the top fitting 14 is then fastened to the upper frame member 17. The door stop previously removed from the frame member 17 is then trimmed to allow the upper end of the mullion 13 to slip through freely. The mullion installation is then completed as described above.

The mullion arrangement 10 according to the invention can also be utilized in a retrofit installation wherein the upper frame member 17 has a non-removable door stop. More specifically, the exact center of the doors is marked on the upper frame member 17 and on the door stop, and this center line is marked on the front beveled edge 70 of the top fitting 14. In this situation, the top fitting 14 mounts directly on the door stop. The top fitting 14 is then positioned on the door stop of frame member 17 so that the centerline on the frame member 17 and the centerline on the top fitting 14 are aligned and so that the top fitting 14 is positioned 9/32 inch behind the front edge of the door stop. Fastener hole locations and the hole for the female connector 75 are then marked and holes are drilled. The female connector 75 is installed within top fitting 14 and the top fitting 14 is fastened to the the door stop. If the rear edge of the top fitting 14 hangs over the back of the door stop, then a shim is installed to support the top fitting 14. Mullion installation is completed as described above.

The mullion arrangement 10 according to the invention is anodized or painted at the factory to match new or existing door frames, whereas the known mullion as described above is typically coated with gray primer only and thus must be painted in the field. The known mullion also does not utilize a cable restraint interiorly of the mullion, meaning that the cable is loose and if the mullion is accidentially dropped, it is possible that the wires can be pulled out of their connections at the strike.

Further, the top fitting 14 according to the the invention is flush with the door stop when the mullion 13 is removed, which allows full access through the doorway defined by the door frame 11. In the illustrated embodiment, the top fitting 14 is flush with a 5/8 inch door stop, while the top fitting in the known mullion arrangement projects 3 and 1/8 inch downwardly into the door opening. The bottom fitting 15 protrudes a minimal distance upwardly from the floor 12 (i.e. 5/8 inch) when the mullion 13 is removed, while the bottom fitting of the known mullion protrudes 1 and 1/8 inch upwardly. In addition, with new installations, the female connector 75 is factory-inserted into the top fitting 14, and the lock nut 89 is applied to the upper side of connector 75, which, along with the hexagonal bore part 68 and its keyed engagement with the hexagonal part 80 of connector 75, makes the connector 75 highly vibration, shock and tamper resistant. Further, this arrangement orients the polarization groove 87 permanently in one position. The known mullion includes a receptacle which is rotatable 360 degrees relative to the top fitting which causes the polarization flat to be any random location, which can make connection of the cable difficult. Further, the known mullion includes a lightweight internal tooth lock washer and jamb nut to fasten the receptacle to a spacer plate, and the jamb nut can be tampered with and removed when the mullion is not installed. Further, this design has limited vibration and shock resistance.

In some situations wherein frequent removal of the mullion 13 is not necessary, a keyed locking mechanism such as mechanism 30 may not be desirable or necessary. In these situations, the locking mechanism 30 is eliminated, and fasteners are then inserted through the opposite side walls 21 of the mullion 13 directly into the upright longitudinal sides of the bottom fitting 15. The mullion 13 is then removed from the door frame by removing these fasteners from the bottom fitting 15 so as to free the lower end of the mullion 13, and then disengaging the upper end of the mullion 13 from the top fitting 14.

Although a particular preferred embodiment has been disclosed in detail for illustrative purposes, it will be recognized that variations or modifications of the disclosed apparatus, including the rearrangement of parts, lie within the scope of the present invention.

What is claimed is:

1. A mullion arrangement for mounting within a door frame defined by a pair of generally horizontal and laterally spaced side frame members and a generally horizontal top frame member extending transversely between the side frame members, said arrangement comprising:

a top fitting secured to a top frame member, said top fitting mounting thereon a power receptacle associated with a power source;

a bottom fitting secured to a generally horizontal support surface, said bottom fitting being spaced downwardly from a top frame member;

a mullion removably positioned within an opening defined by a door frame and having top and bottom end portions respectively engaged with said top and bottom fittings, said mullion defining a cavity therein; and a power cable disposed within said cavity and being connected to an electrical component mounted on said mullion, said power cable including a connector configured to mate with said power receptacle to provide electrical power to said component, said top fitting being configured to permit mounting thereof in substantially flush relation with a lower surface of a top frame member to allow unobstructed access to said power receptacle during installation of said mullion within a door frame.

2. The arrangement of claim 1 wherein said mullion includes a locking arrangement which cooperates with said bottom fitting, said locking arrangement being movable into a locked position to prevent removal of said mullion from a door frame and an unlocked position for allowing removal of said mullion from a door frame.

3. The arrangement of claim 2 wherein said locking arrangement is key-actuated and is disposed interiorly of said mullion, said locking arrangement including a locking bolt having a lower end which is translationally movable within said bottom end portion of said mullion into a locked position wherein said locking bolt is engaged within an opening defined in said bottom fitting and an unlocked position wherein said locking bolt is disengaged from said bottom fitting.

4. The arrangement of claim 2 wherein said mullion is defined by a pair of parallel side walls and a pair of parallel end walls which extend transversely between and interconnect said side walls, said side and end walls defining said cavity in which said power cable is disposed.

5. The arrangement of claim 4 wherein said locking arrangement is disposed within said cavity at said bottom end portion of said mullion and cooperates with said bottom fitting to lock said mullion between said top and bottom fittings.

6. The arrangement of claim 4 wherein one of said end walls is a front end wall which faces towards an exterior of a door frame and the other of said end walls is a rear end wall which faces towards an interior of a door frame, said front end wall at said bottom end portion of said mullion defining therein a downwardly opening recess of short vertical extent to allow said bottom end portion of said mullion to receive said bottom fitting therein during installation of said mullion within a door frame.

7. The arrangement of claim 2 wherein said locking arrangement includes an elongate rod which moves vertically into and out of an upwardly opening hole defined in said bottom fitting.

8. The arrangement of claim 1 wherein said mullion mounts a locking assembly within said cavity, said locking assembly including a locking rod which engages within an opening defined in said bottom fitting to secure said mullion between said top and bottom fittings.

9. The arrangement of claim 1 wherein said mullion includes a bracket mounted within said cavity to restrain movement of said power cable.

10. The arrangement of claim 1 wherein said top fitting is a flat, plate-shaped member which is secured to a top frame member between a pair of elongated door stops mounted thereon, and an upper open end of said mullion seats over said top fitting and nests between a pair of door stops.

11. The arrangement of claim 10 wherein said bottom fitting is a flat, plate-shaped member which projects upwardly and into an open lower end of said mullion.

12. The arrangement of claim 11 wherein said mullion mounts a locking mechanism with said cavity, said locking mechanism including an elongate member which is movable into an opening defined in said bottom fitting to lock said mullion between said top and bottom fittings, said elongate member being movable out of said opening to permit removal of said mullion from a door frame.

13. The arrangement of claim 1 wherein said component is an electric door strike mounted on an exterior side surface of said mullion so as to cooperate with a door swingably mounted on a door frame.

14. The arrangement of claim 1 wherein said cavity opens upwardly through said top end portion of said mullion and said power cable extends upwardly through said top end portion for connection to said power receptacle.

15. The arrangement of claim 1 wherein said top end portion of said mullion defines a terminal end thereof and has a hollow interior which communicates with said cavity of said mullion, wherein said terminal end telescopes over said top fitting so as to be disposed in surrounding relation therewith, said top fitting projecting fully into said hollow interior of said terminal end such that said top fitting is completely concealed when said mullion is secured in place between said top and bottom fittings.

16. The arrangement of claim 1 wherein said top fitting mounts said power receptacle closely adjacent a lower terminal surface thereof, said top fitting being flat and block-shaped and without downwardly extending protrusions thereon such that said power receptacle is laterally unobstructed by said top fitting.

17. The arrangement of claim 1 wherein said power receptacle is stationarily mounted within said top fitting in a fixed position relative thereto.

18. A door arrangement defining an entryway of a building, said arrangement comprising:

a door frame including a pair of generally upright and laterally spaced side frames and a generally horizontal header extending transversely between upper end portions of said side frames;

an upper mounting member of a small vertical dimension fixed to said header at a generally central location therealong, and mounting therein a receptacle, wherein said upper mounting member is configured such that said upper mounting member does not project a significant distance downwardly from said header and such that said upper mounting member does not laterally obstruct said receptacle;

a lower mounting member of a small vertical dimension fixed to a floor beneath said upper mounting member;

a mullion removably mounted in said door frame, said mullion having upper and lower ends removably engaged with said upper and lower mounting members; and power cabling disposed within said mullion, said power cabling having a connector removably engaged with said receptacle and connected to a component associated with an entryway.

19. The arrangement of claim 18 further including a pair of doors mounted to said door frame on opposite sides of said mullion.

20. The arrangement of claim 19 wherein said header mounts a pair of elongate door stops thereon which project downwardly from said header for engagement with the respective doors, said upper mounting member being disposed between terminal inner edge portions of the respective door stops and having a lower generally horizontal surface which is substantially flush with lower generally horizontal surfaces of the respective door stops.

21. The arrangement of claim 18 wherein said power cabling is connected to a component provided on said mullion to provide electrical power thereto.

22. The arrangement of claim 18 wherein said upper mounting member is generally planar in configuration and constitutes the sole member at the upper end of the mullion for securing said upper end to said header.

23. The arrangement of claim 18 wherein said upper end of said mullion defines a terminal end thereof, said mullion having a hollow interior which opens upwardly through said terminal end, wherein said terminal end telescopes over said upper mounting member so as to be disposed in surrounding relation therewith, said upper mounting member projecting fully into said terminal end such that said upper mounting member is completely concealed when said mullion is secured in place between said upper and lower mounting members.

24. The arrangement of claim 18 further including a generally vertically oriented locking rod having a lower end which engages within an upwardly opening hole disposed in said lower mounting member to lock said mullion in said door frame.

25. The arrangement of claim 18, wherein said upper mounting member is free of downwardly extending protrusions.

26. A removable post arrangement for mounting within a doorway including a pair of generally vertically oriented side frame members and a generally horizontally oriented top frame member interconnecting the side frame members, said arrangement comprising:

an upper mounting element fixed to a top frame member inwardly of respective side frame members, said upper mounting element mounting therein a cabling receptacle adjacent a lower terminal surface thereof, said upper mounting element being flat and block-shaped and without downwardly extending protrusions thereon such that said receptacle is unobstructed laterally by said upper mounting element;

a lower mounting element secured to a generally horizontal support surface, said lower mounting element being in vertical alignment with said upper mounting element;

a rigid and hollow post removably disposed within a doorway and including upper and lower terminal end portions which are respectively engaged with said upper and lower mounting elements, said post having disposed therein cabling connected to a component associated with a doorway, said cabling having a connector configured to mate with said receptacle; and a locking arrangement disposed interiorly of said post and including a locking element disposed for cooperation with said lower mounting element and movable into a locked position wherein said locking element engages said lower mounting element to secure said post within a doorway and an unlocked position wherein said locking element is disengaged from said lower mounting element to allow removal of said post from a doorway.

27. The post arrangement of claim 26 wherein said cabling includes a power cable electrically connected to a component associated with a doorway to provide power thereto.

28. The post arrangement of claim 26 wherein said locking element comprises an elongate and generally vertically oriented locking rod having a lower end which is engaged within an upwardly opening hole defined in said lower mounting element when said rod is disposed in the locked position.

29. The post arrangement of claim 26 wherein said hollow post opens through both said upper and lower terminal end portions thereof, and said upper terminal end portion telescopes over said upper mounting element so as to be disposed in surrounding relation therewith, said upper mounting element projecting fully into said upper terminal end portion such that said upper mounting element is completely concealed when said post is secured in place between said upper and lower mounting elements.

30. The post arrangement of claim 26, wherein said cabling comprises a power cable connected to a component associated with a doorway and said receptacle comprises a power receptacle, said receptacle being stationarily mounted within said upper mounting element in a fixed position relative thereto.

* * * * *